US005975532A

United States Patent [19]

Karttunen et al.

[11] Patent Number: 5,975,532

[45] Date of Patent: Nov. 2, 1999

[54] SEAL CONSTRUCTION FOR A SUCTION ROLL IN A PAPER MACHINE

[75] Inventors: Heikki Karttunen, Jyväskylä; Hannu Savolainen, Petäjävesi, both of Finland

[73] Assignee: Valmet Corporation, Helsinki, Finland

[21] Appl. No.: 08/857,705

[22] Filed: May 16, 1997

Related U.S. Application Data

[63] Continuation of application No. 08/743,090, Nov. 4, 1996, abandoned.

[30] Foreign Application Priority Data

Nov. 3, 1995 [FI] Finland ..... 955275

[51] Int. Cl.[6] ..... D21F 3/10

[52] U.S. Cl. ..... 277/300; 277/345; 277/583; 162/371

[58] Field of Search ..... 162/371, 363, 162/358.3; 277/300, 345, 500, 578, 583, 589, 605, 646, FOR 123, FOR 124, FOR 142, FOR 148, FOR 166, FOR 216, FOR 242; 100/121

[56] References Cited

U.S. PATENT DOCUMENTS

| | | | |
|---|---|---|---|
| 754,036 | 3/1904 | Andrews | 162/369 |
| 2,274,641 | 3/1942 | Abbott et al. | 162/371 |
| 2,649,719 | 8/1953 | Hornbostel | 162/371 |
| 3,017,930 | 1/1962 | Dunlap | 162/363 X |
| 3,737,139 | 6/1973 | Watts | 251/1.2 |
| 3,802,961 | 4/1974 | Grass et al. | 162/371 |
| 4,058,435 | 11/1977 | Williams, Jr. | 162/371 |
| 4,399,317 | 8/1983 | Van Dyk, Jr. | 277/646 X |
| 4,915,787 | 4/1990 | Branyon et al. | 162/199 |
| 5,014,917 | 5/1991 | Sirocky et al. | 277/345 X |
| 5,143,015 | 9/1992 | Lubitz et al. | 166/187 |
| 5,580,424 | 12/1996 | Snellman | 162/371 |

FOREIGN PATENT DOCUMENTS

| | | |
|---|---|---|
| 771973 | 1/1978 | Finland . |
| 76388 | 10/1984 | Finland . |
| 934909 | 11/1993 | Finland . |
| 386700 | 5/1914 | Sweden . |

*Primary Examiner*—Lynne Reichard
*Assistant Examiner*—Greg Binda
*Attorney, Agent, or Firm*—Steinberg & Raskin, P.C.

[57] ABSTRACT

A seal construction for a suction roll in a paper machine including a substantially U-section holder open toward an inner face of the roll mantle and a seal mounted in the holder and extending in the axial direction of the roll. The seal includes a frame part arranged within the holder and a wear part fixed to the frame part and placed against the inner face of the roll mantle. The seal construction also includes a loading hose for shifting the seal in the holder against the inner face of the roll mantle. In the interior of the frame part of the seal, an inner loading member is arranged to lock the frame part of the seal in contact with the holder so as to position the wear part of the seal in the desired position in relation to the inner face of the roll mantle.

15 Claims, 4 Drawing Sheets

SEAL CONSTRUCTION FOR A SUCTION ROLL IN A PAPER MACHINE

RELATED APPLICATION

This application is a continuation application of U.S. patent application Ser. No. 08/743,090 filed Nov. 4, 1996, now abandoned.

FIELD OF THE INVENTION

The invention relates to a seal construction for a suction roll in a paper machine comprising a substantially U-section holder open toward an inner face of a roll mantle of the suction roll and a elongate seal mounted in the holder and which extends in the axial direction of the roll. The seal includes a frame part arranged in the holder and a wear part fixed to the frame part and operatively positioned in opposed relationship to the inner face of the roll mantle. The seal construction also comprises loading means, such as a loading hose or equivalent, by whose means the seal can be displaced in the holder against the inner face of the roll mantle.

The invention also relates to a method for sealing a vacuum space or vacuum chamber in a suction box of a suction roll in which negative pressure is produced.

BACKGROUND OF THE INVENTION

In suction rolls in paper machines, the wear of seals has constituted a rather significant problem. This problem has been emphasized in particular because it has been a general aim of seal constructions to obtain longer servicing intervals. The seals in a suction roll divide the interior of the roll mantle appropriately into vacuum chambers, and by means of a vacuum passed into these vacuum chambers, a suction effect is applied through holes formed in the roll mantle to the paper web running over an outer face of the roll mantle in order that the web should remain on the face of the roll mantle in the desired manner and over a desired circumferential distance of the suction roll. The seals are loaded against the inner face of the roll mantle. In an attempt to obtain an efficient and well-sealed suction roll, in earlier constructions, the seals in the suction roll were pressed, for example by means of compressed air, against the inner face of the roll mantle. The compression force was maintained constantly throughout operation of the suction roll which resulted in quite rapid wear of the seals. Moreover, a high compression force required water lubrication of the seals with abundant quantities of water. Further, owing to the high compression force, the power consumption of the sealing construction was considerable.

In view of eliminating this problem of wear, in the current assignee's earlier Finnish Patent Application No. 934909 (which corresponds to U.S. Pat. No. 5,580,424, the entire specification of which is incorporated by reference herein), the seals were not loaded constantly against the inner face of the roll mantle of the suction roll. Rather, the seals were provided with locking means so that initially the seal was pressed against the inner face of the roll mantle, and after a vacuum had been generated in the vacuum chamber defined by the seals, the seal was locked in its holder. Then it was possible to eliminate the load with which the seals were pressed against the inner face of the roll mantle while maintaining the seal in pressing engagement with the inner face of the roll mantle. In this manner, the wear of the seals could be reduced substantially, compared with the prior art constructions, and it was often even possible to eliminate the water lubrication of the seals. However, this earlier construction of the current assignee involved a quite substantial problem in that, in order for the desired sealing effect to be provided, the manufacturing tolerances of the seal construction were very small. Owing to these small tolerances, a detrimental consequence could be sticking of the seal in its position, as a result of which the desired sealing effect was not produced. It is another quite noticeable problem or drawback of this construction that the seal construction with the holders included in it was a rather exceptional, non-conventional construction, so that when this construction is applied in a suction roll, the entire seal construction with all of its components had to be changed to suit this specific seal construction.

OBJECTS AND SUMMARY OF THE INVENTION

Accordingly, it is an object of the present invention to provide a novel and improved seal construction for a suction roll in a paper machine, by means of which the problems related to the earlier constructions, e.g., excessive wear, exceptional and non-conventional construction, requirement of excessive water lubrication and requirement of excessive compression force, are eliminated and solved.

It is another object of the invention to provide a new and improved seal construction for a suction roll of a paper machine.

It is yet another object of the invention to provide and new and improved method for sealing a vacuum space or vacuum chamber in a suction box of a suction roll in which negative pressure is produced.

In view of achieving the objects of the invention, the seal construction in accordance with the invention comprises a holder, a seal arranged at least partially within the holder and an inner loading member arranged in an interior of a frame part of the seal and which is adapted to lock the frame part of the seal in contact with the holder of the seal so as to position a wear part of the seal in a desired position in relation to the inner face of the roll mantle.

By means of the present invention, considerable advantages are obtained over the prior art constructions, and of these advantages should be mentioned the simplicity of the construction and, as a result of the simplicity, reliability in operation, as well as the fact that, when an existing seal construction is replaced, in many cases the holder of the existing seal can be retained unchanged without having to replace it. Further, as a result of the invention, a non-rubbing and, therefore, substantially non-wearing seal construction has been provided, and the consumption of power caused by the seal construction is very low, compared with earlier constructions.

In certain embodiments, the frame part is made of an elastic material and has a hollow interior cavity or compartment and the holder has inner walls facing the frame part and whereby the inner loading member is arranged inside the compartment in the frame part such that the loading produced upon pressurization of the inner loading member expands the frame part and forces it into contact with the inner walls of the holder to lock the wear part in a fixed position. In view of the construction of the frame part, the expansion of the frame part by the loading produced upon pressurization of the inner loading member causes a rotational movement of a portion of the frame part around contact points defined between support points of the frame part and the inner walls of the holder such that the wear part of the seal is shifted away from the inner face of the roll mantle when the seal is locked in its fixed position.

In another embodiment, the seal construction includes a first support plate arranged in the holder under the wear part and a second support plate arranged in the holder above the loading means. The frame part comprises an articulation mechanism including articulation rods linked together and to the first and second support plates. The inner loading member is arranged inside the articulation mechanism. More particularly, the articulation rods comprise first, second, third and fourth articulation rods, the first and second articulation rods being linked with the first support plate and the third and fourth articulation rods being linked with the second support plate. The holder has first and second opposed inner walls. The articulation mechanism further include joint means for defining a first pivotable joint between the first articulation rod and the third articulation rod and against the first inner wall of the holder and a second pivotable joint between the second articulation rod and the fourth articulation rod and against the second inner wall. The loading produced upon pressurization of the inner loading member causes the first and second pivotable joints to be pressed against the first and second inner walls of the holder, respectively, and lock the seal in its fixed position. The articulation mechanism is structured and arranged such that pressing of the first and second pivotable joints against the first and second inner walls of the holder causes the wear part to be shifted apart from the inner face of the roll mantle. The articulation rods of the articulation mechanism are arranged to form a quadrangle whereby joint means are provided for pivotally coupling adjacent ones of the articulation rods.

The method for sealing a vacuum chamber or vacuum space in a suction box of a suction roll in which negative pressure is produced in accordance with the invention comprises the steps of arranging a seal mounted between first and second opposed inner walls of a substantially U-shaped holder at an edge of the vacuum space, pressing a wear part of the seal against an inner face of a roll mantle of the suction roll, and pressing a frame part of the seal against the first and second inner walls of the holder to lock the seal in the holder after the negative pressure has been generated in the vacuum space in the suction box when the seal is in pressing engagement with the inner face of the roll mantle. To obtain the full advantages in accordance with the invention, the pressing of the seal against the inner face of the roll mantle of the suction roll is released after the seal has been locked in the holder such that the seal remains in proximity to the inner face of the roll mantle. In other embodiments, the wear part of the seal is pressed against the inner face of the roll mantle by arranging a pressurizeable loading member between a bottom surface of the frame and directing a pressurizing medium into the loading member. The frame part of the seal can be pressed against the first and second inner walls of the holder by providing an interior space in the frame part, arranging a pressurizeable loading member in the interior space and directing a pressurizing medium into the loading member. The wear part of the seal may be attached to the frame part of the seal and the frame part of the seal constructed such that upon pressing of the frame part of the seal against the first and second inner walls of the holder, the wear part of the seal is shifted away from the inner face of the roll mantle.

Further advantages and characteristics of the invention come out from the following detailed description of the invention.

BRIEF DESCRIPTION OF THE DRAWINGS

The following drawings are illustrative of embodiments of the invention and are not meant to limit the scope of the invention as encompassed by the claims.

DESCRIPTION OF THE PREFERRED EMBODIMENTS

Figure 1:
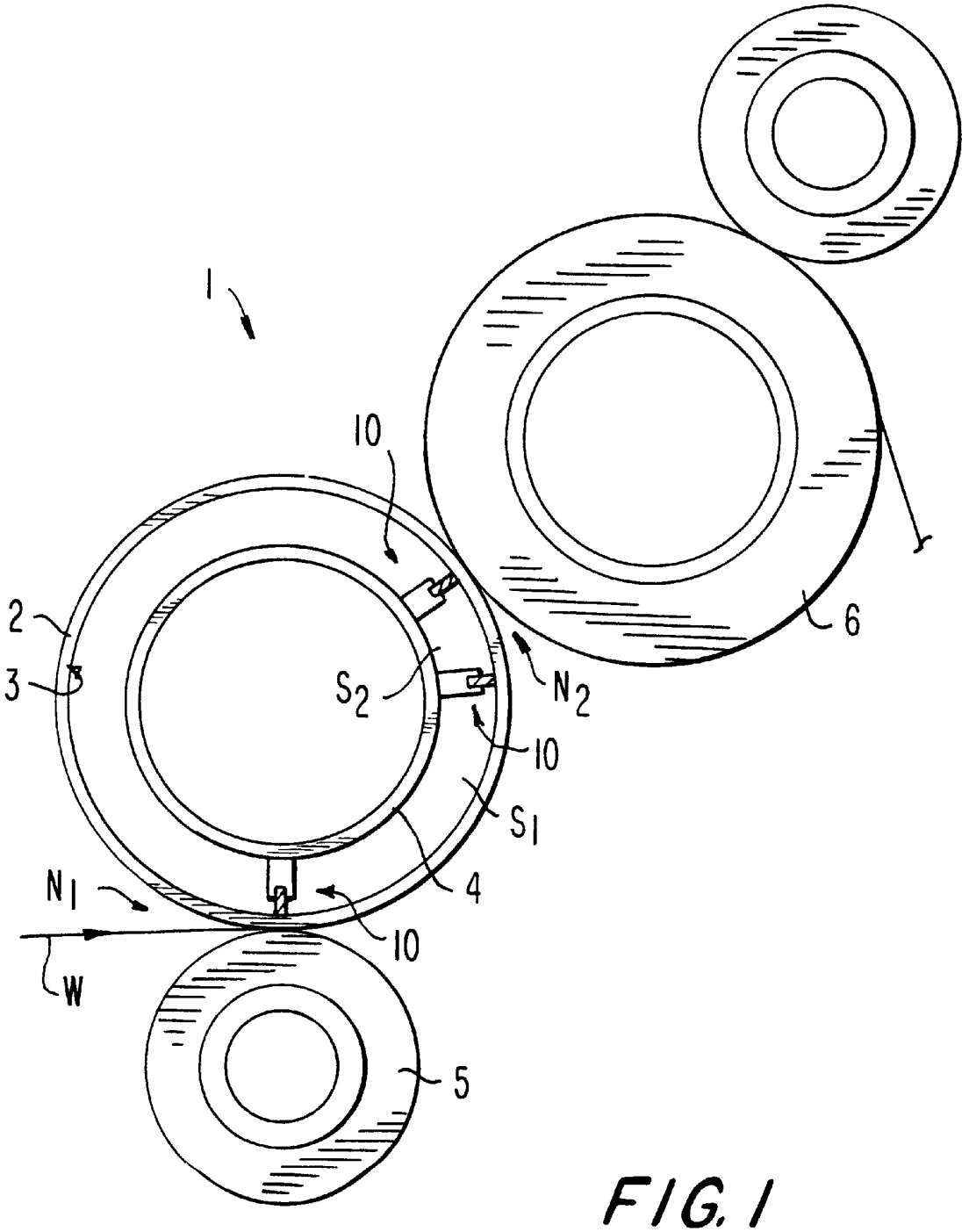
FIG. 1 is a fully schematic illustration of a suction roll in a paper machine in which a seal construction in accordance with the invention is used.

Referring to the accompanying drawings wherein the same reference numerals refer to the same or similar elements, FIG. 1 shows conventional operation of a suction roll in a paper machine, to which a seal construction in accordance with the invention can be applied. A paper web W is passed through a nip $N_1$ formed between a suction roll 1 and a first backup roll 5 onto a face of a roll mantle 2 of the suction roll 1 and along the face of the roll mantle 2 into a nip $N_2$ formed between the suction roll 1 and a second backup roll 6. From the nip $N_2$, the web is passed to further treatment. In the interior of the suction roll 1, there is a suction box 4 including seal constructions 10 which form vacuum chambers $S_1$ and $S_2$ between them. According to FIG. 1, the seals rest against an inner face 3 of the roll mantle 2. By means of the vacuum present in the vacuum chambers $S_1$,$S_2$, the web W is kept in the desired manner against the outer face of the roll mantle 2 and/or water is sucked out of the web W into the vacuum chambers $S_1$,$S_2$. The arrangement described in FIG. 1 involves nothing in itself novel, but the arrangement is as such known and included in the prior art. Rather, the novelty of the invention is related to the seal constructions 10 shown in FIG. 1, which are illustrated in more detail in FIGS. 2 and 3. Thus, it should be understood at this stage that the illustration in FIG. 1 does not limit the position or use of a suction roll including the novel seal constructions in accordance with the invention.

Seal constructions 10 may be elongate and extend in an axial direction of the suction roll 1.

Figure 2:
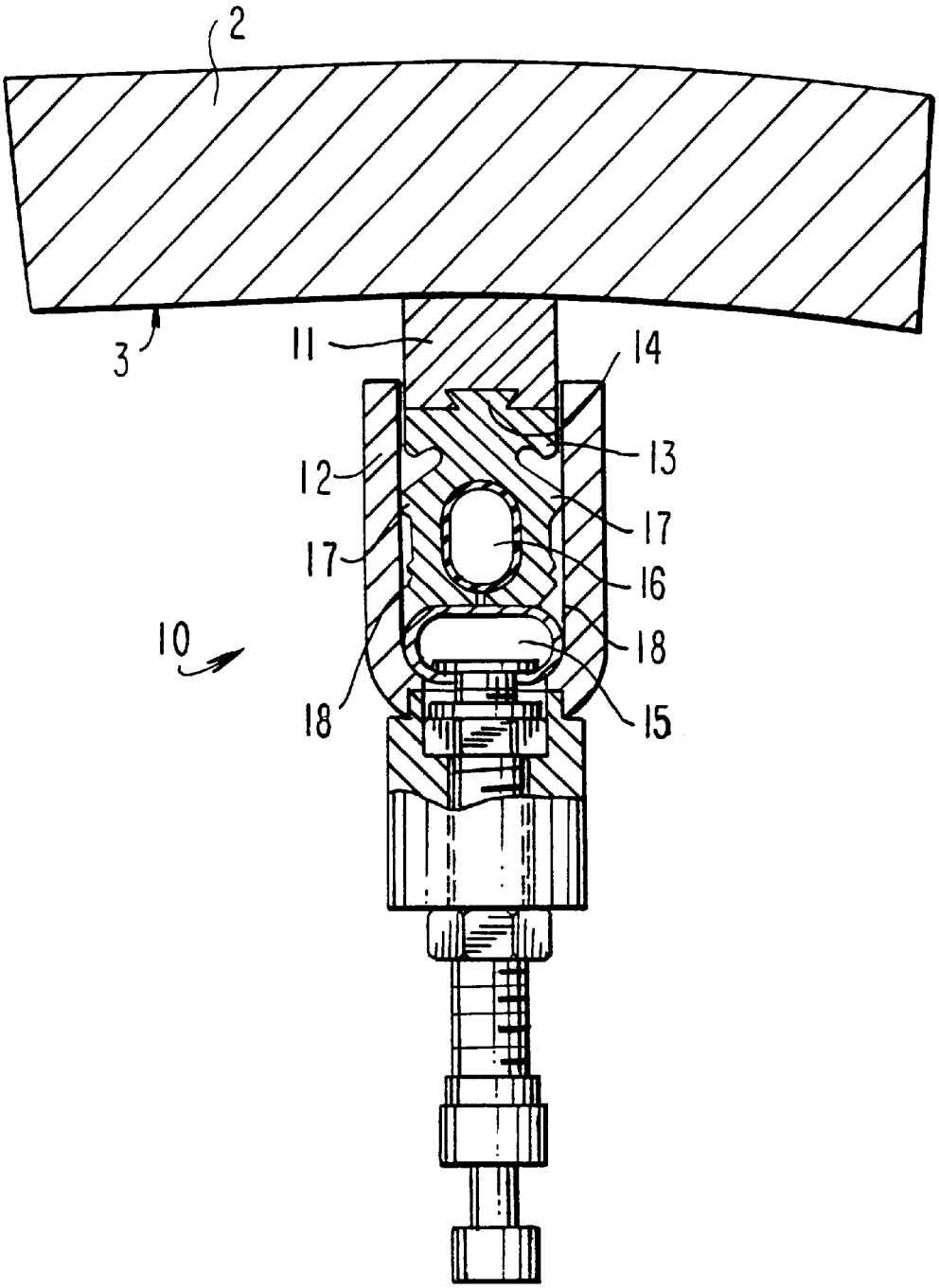
FIG. 2 is a more detailed sectional view of a first embodiment in accordance with the invention of the seal construction for a suction roll.

In FIG. 2, a first embodiment of the seal construction in accordance with the invention is denoted generally by reference numeral 10. The seal construction 10 comprises the seal itself having a wear part 11 mounted in a U-section holder 12 which is open toward the inner face 3 of the roll mantle 2. In the embodiment shown in FIG. 2, the wear part 11 is fixed to a frame part 13 of the seal, the frame part 13 being made of an elastic material. The connecting means or joint between the wear part 11 and the frame part 13 of the seal is denoted by reference numeral 14, and as shown in FIG. 2, the joint 14 is a dovetail joint. The measure of the wear part 11 of the seal is smaller than the inside measure of the holder 12, so that the wear part 11 can move readily in the holder 12, i.e., its dimensions are slightly smaller than the dimensions of the holder. On the contrary, the frame part 13 of the seal is shaped and dimensioned so that the frame part 13 is arranged in the holder 12 with a slight pinching, i.e., contact between the frame part 13 and the holder 12. The support point between the frame part 13 of the seal and the holder 12 at which the pinching occurs is denoted by reference numerals 17. The frame part 13 of the seal thus has a width in a direction transverse to the axial direction of the roll slightly larger than a width of the space between the inner walls of the holder 12.

A loading hose 15 or an equivalent loading member or loading means is arranged under the frame part 13 of the seal on the bottom of the U-section holder 12 and by means of the loading hose, the wear part 11 of the seal can be pressed against the inner face 3 of the roll mantle. Such a mode of loading is common in seal constructions in suction rolls, and it results in the drawbacks that were described above in relation to the description of the prior art. It is one of the most important of these drawbacks that the constant loading of the wear part 11 against the inner face 3 of the roll mantle abrades the seal intensively and rapidly and, as a result of this, reduces the service life of the wear part 11. Owing to the constant loading, in normal cases, the seal construction must also be provided with efficient water lubrication.

Figure 4A:
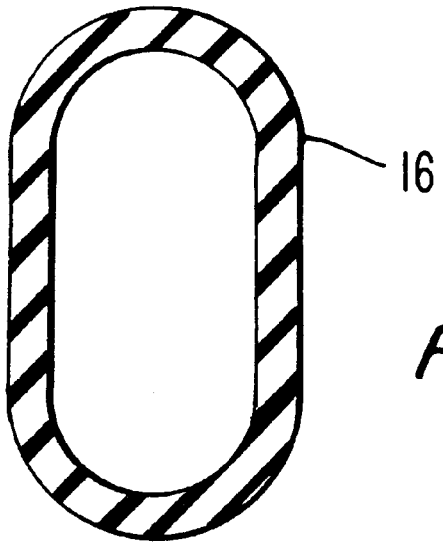
FIG. 4A is a cross-sectionalview of the loading hose in the frame part of the seal construciton shown in FIG. 2.

By contrast, in the present invention, in the embodiment shown in FIG. 2, a loading hose 16 or an equivalent loading member or loading means is arranged in the interior of the frame part 13 of the seal, the frame part being made of an elastic material. The loading hose 16 can be subjected to a pressure and because of this, the wear problem of the seal prevalent in the prior art constructions is substantially solved. Specifically, when the loading hose 16 in the interior of the frame part 13 of the seal is pressurized, the elastic frame part 13 yields, whereby wear projections 18 formed on the side faces of the frame part 13 of the seal are pressed against the walls of the holder 12 and lock the frame part 13 and the wear part 11 of the seal in their positions. Wear projections 18 are initially at a distance from the inner walls of the holder 12 as shown in FIG. 2. When the wear part 11 of the seal is locked in its position, as a matter of course, the procedure is such that when the inside loading hose 16 is pressurized, the wear projections 18 pivot about the support points 17, whereby the elastic frame part 13 of the seal is shaped so that the wear part 11 of the seal is shifted slightly apart from the inner face 3 of the roll mantle. As such, the frame part of the seal has a cross-sectional shape defining the support points 17 on projections of the frame part 13 which extend outward from a central portion of the frame part 13, the support points 17 being supported against inner walls of the holder. In this connection, when the wear projections 18 grasp the walls of the holder 12, the wear part 11 of the seal is locked in its position so that it does not rub against the inner face 3 of the roll mantle. Then, the seal is, of course, not worn. The operation described above, i.e., shifting of the wear part 11 of the seal apart from the inner face 3 of the roll mantle and locking of this wear part in its position, can be achieved simply so that, for example, the inner loading hose 16 in the frame part 13 of the seal is reinforced by means of fabrics in a suitable way, whereby the pressure in the hose 16 produces a movement and a force exactly in the desired direction (FIG. 4A).

Figure 3:
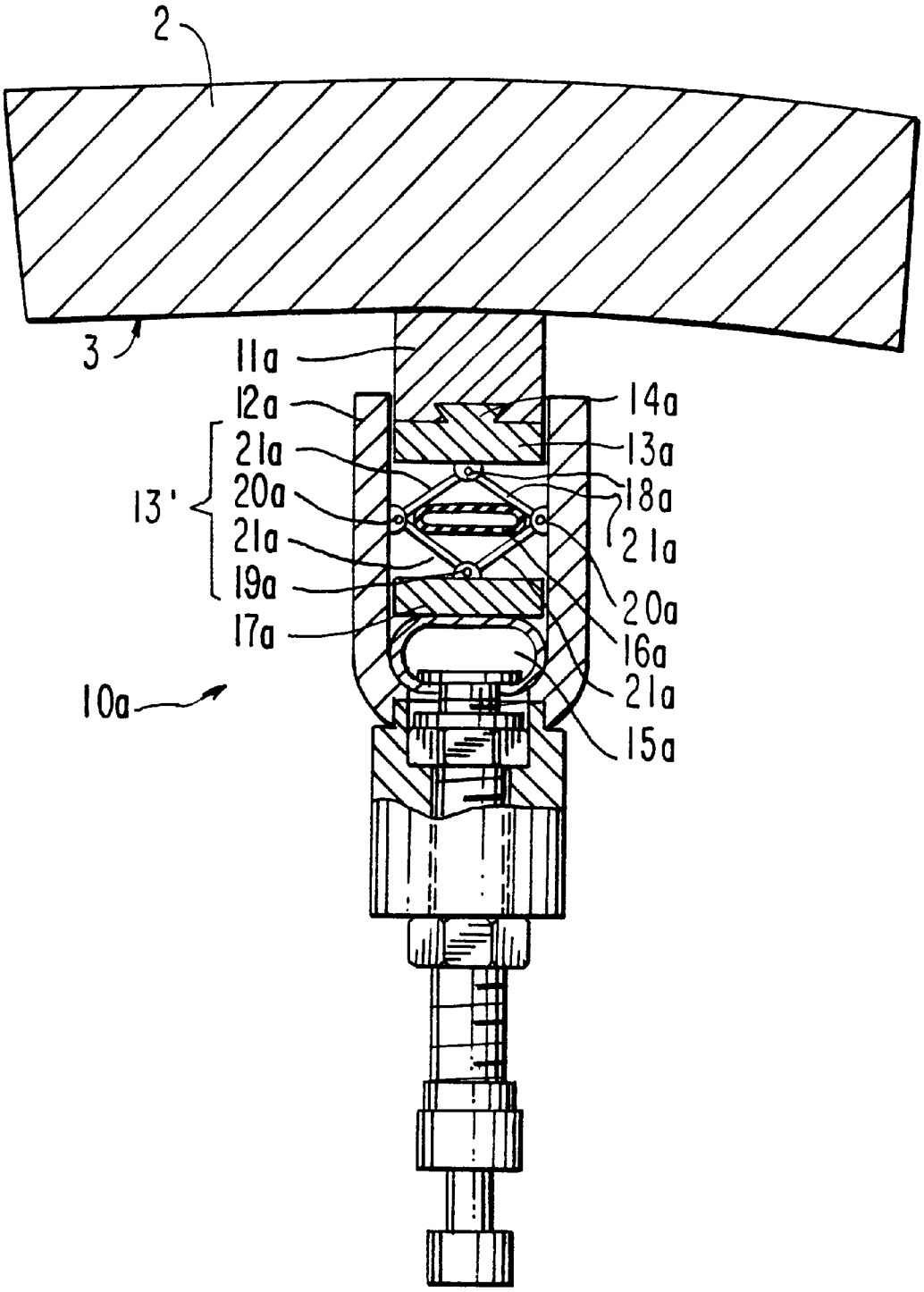
FIG. 3 is an illustration corresponding to FIG. 2 of a second embodiment of the seal construction in accordance with the invention.

FIG. 3 shows a second embodiment of the seal construction in accordance with the invention. In FIG. 3, the seal construction is denoted by reference numeral 10*a* and, as simplified, the seal construction 10*a* comprises a wear part 11*a* of the seal which is movable in a holder 12*a* and which can be shifted against the inner face 3 of the roll mantle 2. The wear part 11*a* and the holder 12*a* of the seal can be exactly identical with those shown in the embodiment of FIG. 2. As is the case in FIG. 2, in the embodiment of FIG. 3, a loading hose 15*a* is arranged on the bottom of the holder 12*a* and by means of this loading hose, the wear part 1*a* of the seal can be loaded against the inner face 3 of the roll mantle by the intermediate of the frame part of the seal. However, whereas in the embodiment shown in FIG. 2, the frame part of the seal comprises a unified single piece made of an elastic material, in the embodiment of FIG. 3, the frame part 13' comprises a first support plate 13*a* attached to the wear part 11*a* of the seal by means of a suitable joint 14*a*, a second support plate 17*a* arranged on the loading hose 15*a*, and an articulation mechanism arranged between these support plates 13*a*, 17*a*. In the illustrated embodiment, the articulation mechanism comprises a quadrangle with articulated, pivotable joints, in which articulated, pivotable joints 18*a*, 19*a* are mounted on the support plates 13*a*, 17*a*, and articulation rods 21*a* are linked with the joints 18*a*, 19*a*. On the other hand, the articulation rods 21*a* coming from the first and second support plates 13*a*,17*a* are again interconnected by means of articulated joints 20*a*. The articulated joints 20*a* which interconnect the articulation rods 21*a* are supported displaceably against the walls of the holder 12*a*. Further, an inner loading hose 16*a* is arranged inside the articulated quadrangle.

Figure 4B:
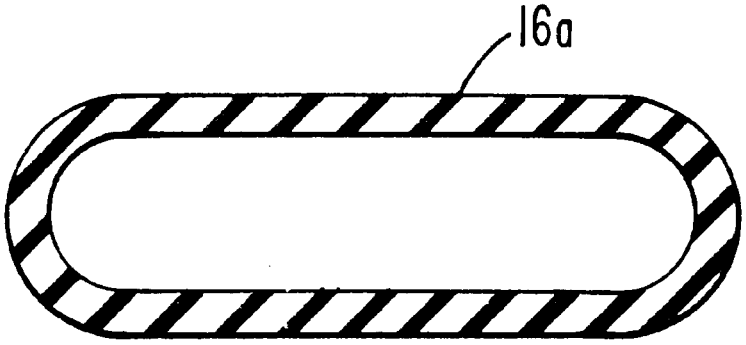
FIG. 4B is a cross-sectional view of the loading hose in the frame part of the seal construction shown in FIG. 3.

The system operates so that, by pressurizing the loading hose 15*a*, the wear part 11*a* of the seal is brought into contact with the inner face 3 of the roll mantle. Thereafter, the inner loading hose 16*a* is pressurized, whereby the articulated joints 20*a* that interconnect the articulation rods 21*a* are pressed against the walls of the holder 12*a* and lock the wear part 11*a* of the seal in its position. At the same time as the articulated joints 20*a* are locked against the walls of the holder 12*a*, owing to the articulation mechanism, the wear part 11*a* of the seal is pulled apart from the inner face 3 of the roll mantle in a manner similar to the embodiment shown in FIG. 2. Thus, the wear part 11*a* of the seal remains non-rubbing in its regulated position, in which case, if necessary, the pressure can be discharged from the loading hose 15*a*. Also in the embodiment of FIG. 3, the desired function of the articulation mechanism can be achieved so that the inner loading hose 16*a* is reinforced appropriately by means of fabrics, whereby the movement and the force produced by the pressure in the hose 16*a* can be made to be formed exactly in the desired direction (FIG. 4B).

As a brief summary of the above, it can still be stated that, by means of the construction of the present invention, a seal is provided that does not rub against the roll mantle during operation of the vacuum chamber of which the seal is associated and that is substantially non-wearing, the power consumption caused by the seal being minimal compared with the prior art constructions.

The examples provided above are not meant to be exclusive. Many other variations of the present invention would be obvious to those skilled in the art, and are contemplated to be within the scope of the appended claims.

We claim:

1. A seal construction for a suction roll in a paper machine having a roll mantle, comprising a substantially U-shaped holder having an opening adapted to be oriented toward an inner face of the roll mantle, said holder including inner walls, a seal mounted at least partially in said holder, said seal including a frame part arranged at least partially in said holder and between said inner walls and a wear part attached to said frame part, said frame part being made of an elastic material and having a hollow interior compartment, loading means for urging said frame part of said seal out of said holder, and locking means for locking said frame part of said seal in contact with said holder said locking means comprising an inner loading member arranged in said interior compartment of said frame part such that the loading produced upon pressurization of said inner loading member expands said frame part of said seal and forces said frame part of said seal into contact with said inner walls of said holder to thereby lock said wear part of said seal in a fixed position.

2. The seal construction of claim 1, wherein said seal is elongate and extends in an axial direction of the roll.

3. The seal construction of claim 1, wherein said frame part of said seal has a width slightly larger than a width of said opening of said holder.

4. The seal construction of claim 1, wherein said frame part of said seal has a cross-sectional shape defining support points on projections of said frame part of said seal which extend outward from a central portion of said frame part of said seal.

5. The seal construction of claim 4, wherein said support points are supported against said inner walls of said holder.

6. The seal construction of claim 5, wherein the expansion of said frame part of said seal by the loading produced upon pressurization of said inner loading member causes movement of a portion of said frame part of said seal around contact points defined between said support points of said frame part of said seal and said inner walls of said holder such that said wear part of said seal is shifted in a direction into said holder when said seal is locked in its fixed position.

7. A seal construction for a suction roll in a paper machine, the suction roll having a roll mantle, comprising a substantially U-shaped holder having an opening adapted to be oriented toward an inner face of the roll mantle, said holder including inner walls.

a seal mounted at least partially in said holder, said seal including a frame part arranged at least partially in said holder and between said inner walls and a wear part attached to said frame part, said frame part of said seal being made of an elastic material and having a hollow interior compartment, loading means arranged in said holder for urging said frame part of said seal out of said holder such that said wear part of said seal is urged in a direction away from said holder, said loading means being arranged between a bottom surface of said holder and said frame part of said seal, and locking means for locking said frame part of said seal in a fixed position in said holder said locking means comprising a pressurizeable inner loading member arranged in said interior compartment of said frame part of said seal such that the loading produced upon pressurization of said inner loading member expands said frame part of said seal and forces said frame part of said seal into contact with said inner walls of said holder to thereby lock said wear part of said seal in a fixed position.

8. The seal construction of claim 7, wherein said seal is elongate and extends in an axial direction of the roll.

9. The seal construction of claim 7, wherein said frame part of said seal has a width slightly larger than a width of said opening of said holder.

10. The seal construction of claim 7, wherein said frame part of said seal has a cross-sectional shape defining support points on projections of said frame part of said seal which extend outward from a central portion of said frame part of said seal.

11. The seal construction of claim 10, wherein said support points are supported against said first and second walls of said holder.

12. The seal construction of claim 11, wherein the expansion of said frame part of said seal by the loading produced upon pressurization of said inner loading member causes movement of a portion of said frame part of said seal around contact points defined between said support points of said frame part of said seal and said first and second walls of said holder such that said wear part of said seal is shifted in a direction into said holder when said seal is locked in its fixed position.

13. A method for sealing a vacuum space in a suction box of a suction roll in which negative pressure is produced, comprising the steps of:

arranging a seal mounted between first and second opposed walls of a substantially U-shaped holder at an edge of the vacuum space, said seal being made of an elastic material and having a wear part and a frame part including a hollow interior compartment, said frame part being arranged at least partially between said first and second walls of said holder, pressing said wear part of said seal against an inner face of a roll mantle of the suction roll, arranging a pressurizeable inner loading member in said interior compartment of said frame part, after said wear part of said seal is in pressing engagement with said inner face of said roll mantle, directing a pressurizing medium into said inner loading member to thereby cause said frame part of said seal to be pressed against said first and second walls of said holder and thereby lock said seal in said holder; and releasing the pressing of said wear part of said seal against said inner face of said roll mantle of the suction roll after said seal has been locked in said holder.

14. The method of claim 13 wherein the step of pressing said wear part of said seal against said inner face of said roll mantle of the suction roll comprises the steps of arranging a pressurizeable loading member between a bottom surface of said frame part and directing a pressurizing medium into said loading member.

15. The method of claim 13, further comprising the step of attaching said wear part of said seal to said frame part of said seal and constructing said frame part of said seal such that upon pressing of said frame part of said seal against said first and second inner walls of said holder, said wear part of said seal is shifted away from said inner face of said roll mantle.

* * * * *